US005372363A

United States Patent [19]

Siddle

[11] Patent Number: 5,372,363

[45] Date of Patent: Dec. 13, 1994

[54] COMPOSITE EXPANDABLE BATON WITH MAGNETIC RETAINING MEANS

[75] Inventor: Bruce K. Siddle, Waterloo, Ill.

[73] Assignee: PPCT Management Systems, Inc., Millstadt, Ill.

[21] Appl. No.: 141,068

[22] Filed: Oct. 26, 1993

[51] Int. Cl.[5] ..... F41B 15/02

[52] U.S. Cl. ..... 273/84 R

[58] Field of Search ..... 273/84 R, 84 ES, 80 D, 273/32 F, 68, 69; 135/75; 16/115; 343/901

[56] References Cited

U.S. PATENT DOCUMENTS

| | | | |
|---|---|---|---|
| 4,456,255 | 6/1984 | Braunhut | 273/84 R |
| 4,964,636 | 10/1990 | Ashihara | 273/84 R |
| 5,160,140 | 11/1992 | Starrett | 273/84 R |
| 5,161,800 | 11/1992 | Parsons et al. | 273/84 R |

FOREIGN PATENT DOCUMENTS

| | | | |
|---|---|---|---|
| 0543517 | 7/1957 | Canada | 273/84 R |

*Primary Examiner*—Vincent Millin
*Assistant Examiner*—William M. Pierce
*Attorney, Agent, or Firm*—Paul M. Denk

[57] ABSTRACT

A telescoping baton having a handle section, a middle section which can collapse into the handle section or extend out of the handle section, and an end section which can collapse into the middle section or extend out of the middle section. The handle, middle, and end sections are formed from composite material selected from the group containing nylon, polycarbonate and kevlar. Swaged bores within the handle and middle sections engage raised collars on the middle and end sections respectively to lock the device in the extended position. A metal rod in the end section provides weight and rigidity. A magnet in the end cap of the handle section engages the metal rod when the device is collapsed to releasably hold the baton in the collapsed state.

2 Claims, 2 Drawing Sheets

COMPOSITE EXPANDABLE BATON WITH MAGNETIC RETAINING MEANS

BACKGROUND OF THE INVENTION

This invention relates generally to batons, more particularly to a light weight expandable baton constructed from composite material for use by policemen in the field or during training exercises.

Expandable or telescoping batons are often carried by law enforcement officers or security personnel instead of the traditional, one-piece night stick. Typically, the traditional night stick is made of wood and is approximately 26 inches long and 1¼ inches in diameter. Long, one-piece night sticks are inconvenient to carry for obvious reasons.

Expandable batons have increased in popularity because, in the collapsed state, the overally length of the baton can be as short as eight or nine inches. Generally, expandable batons are constructed in sections which telescope. A tubular main section functions as a handle; progressively smaller, tubular sections fit within each other and can be collapsed into one another or expanded outward. When completely collapsed, the sections all fit within the handle section. When expanded, the sections are locked together, end-to-end, by friction fittings such as taper joints. When expanded, the overall length of the baton can be 18 to 20 inches.

Prior art expandable or telescoping batons are constructed from metal such as soft steel. Batons made from hard steel provide better service but are expensive to manufacture, as are batons constructed from alloy steel.

Metal batons have notable drawbacks. The metal is prone to metal fatigue and can crack or rust. Furthermore, metal batons bear a close similarity to a piece of metal pipe, which is aesthetically unpleasing.

SUMMARY OF THE INVENTION

It is therefore a principle object of the present invention to provide a telescoping baton made of composite material such as kevlar, nylon, or polycarbonate.

Another object of the invention is to provide a telescoping baton made of a composite material having a metal insert in the far end section so as to provide weight and stiffness.

Still another object of the invention is to provide a telescoping baton having a magnet in the handle portion to contact the metal insert in the end portion when the baton is collapsed thereby releasably securing the baton in the collapsed condition for carrying.

In accordance with the invention, generally stated, a telescoping baton is provided having a handle section, a middle section which fits within the handle section, and end section which fits within the middle section. The section can be extended or collapsed into the handle section. The handle, middle section, and end section are all formed from a composite material selected from the group containing polycarbonate, nylon and kevlar. A magnetically attractive metal rod is inserted in the end section. A magnet, located in the handle section, magnetically adheres to the metal rod when the baton is collapsed thereby releasably holding the baton in the collapsed state.

DESCRIPTION OF THE PREFERRED EMBODIMENT

Figure 1:
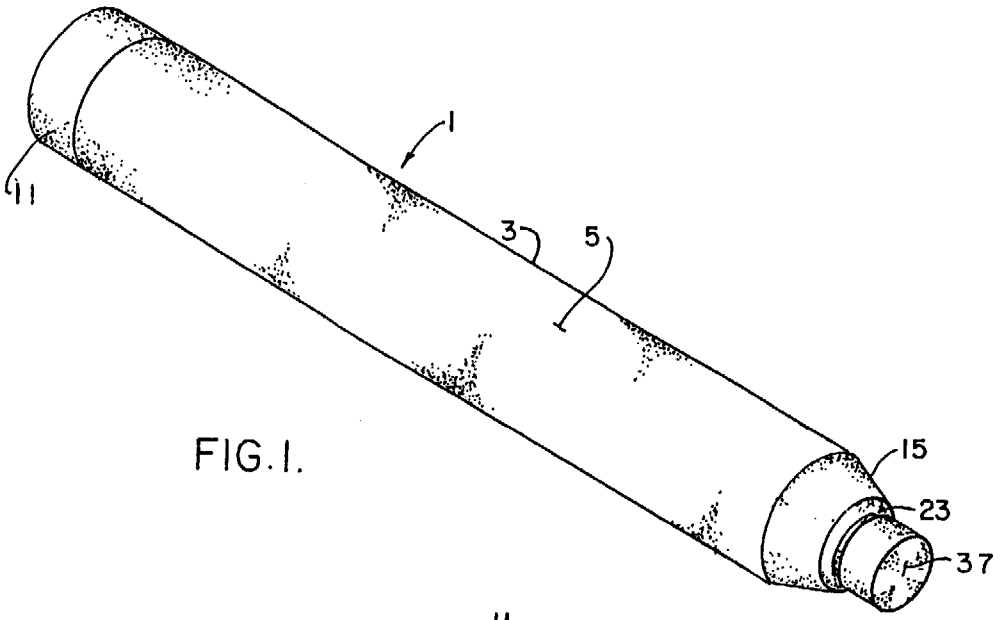
FIG. 1 is perspective view of the telescoping baton of the present invention in the collapsed state.
Figure 2:
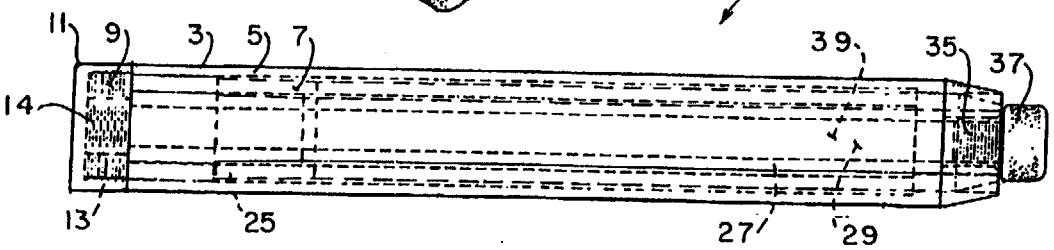
FIG. 2 is a side elevational view of the telescoping baton of the present invention in a collapsed state, showing the arrangement of the internal elements in phantom.
Figure 3:
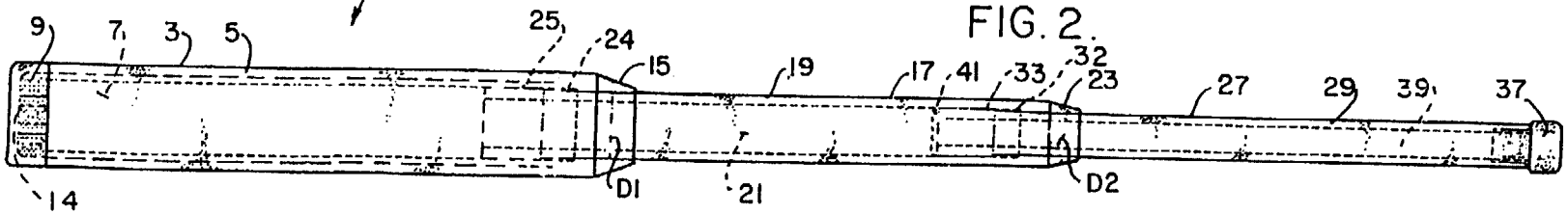
FIG. 3 is a side elevational view of the telescoping baton of the present invention in an extended state, showing the arrangement of the internal elements in phantom.
Figure 4:
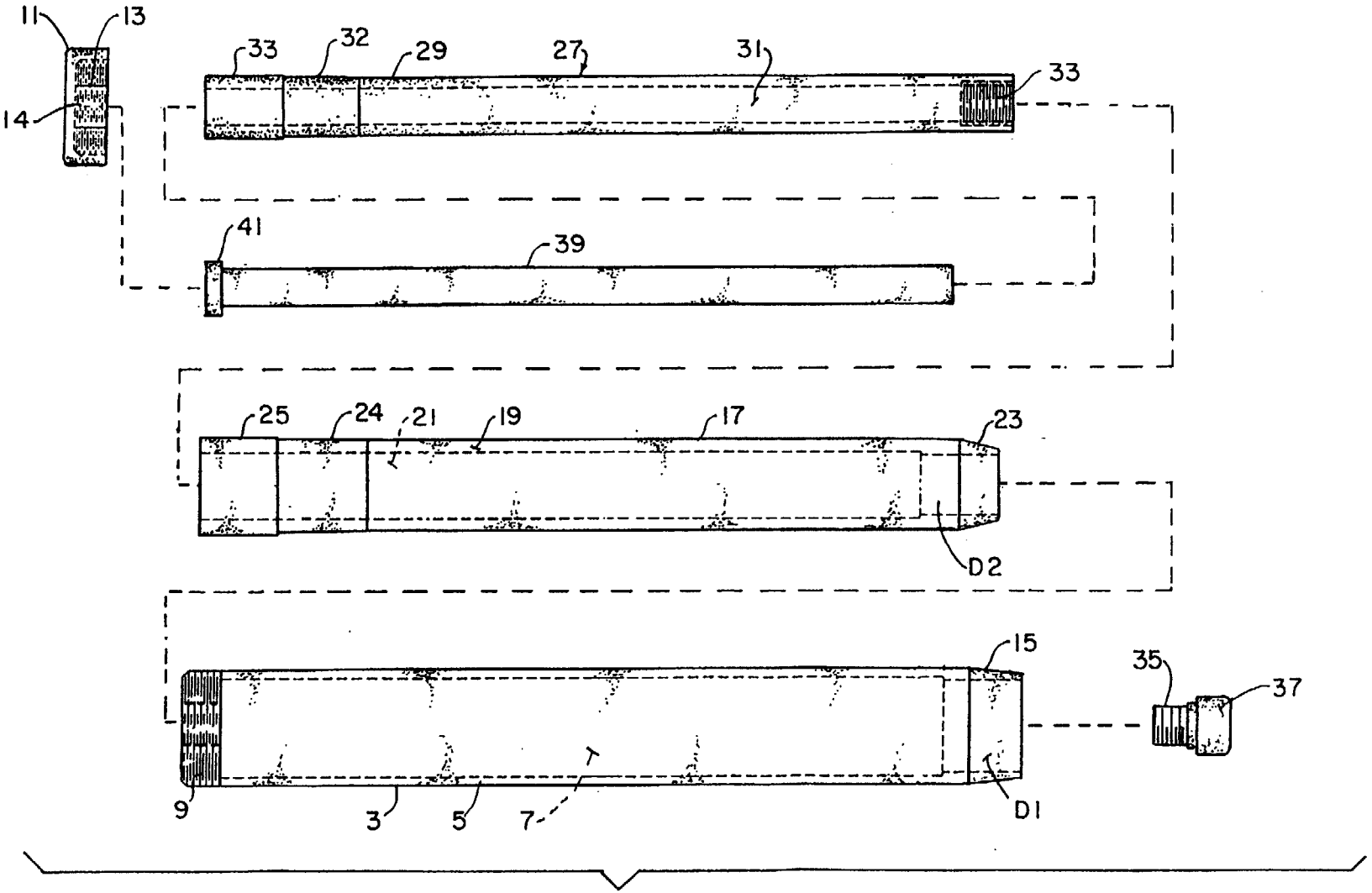
FIG. 4 is an exploded view of the telescoping baton of the present invention.

A telescoping baton of the present invention is indicated generally by reference numeral 1 in FIGS. 1-3. Baton 1 is shown in a collapsed state in FIGS. 1 and 2 and extended position in FIG. 3.

Baton 1 is comprised of a handle section 3 which is formed of a cylindrical wall 5 defining an internal bore 7. Handle section 3 can be formed from an appropriate composite material such as nylon, polycarbonate, or kevlar. Bore 7 has a diameter slightly greater than the outside diameter of the second section as will be described below.

Handle section 3 has threads 9 formed externally on the aft end for the threaded engagement of end cap 11. End cap 11 has internal threads 13 to engage threads 9. A cylindrical magnet 14 is positioned centrally in cap 11 to releasably secure the baton in a collapsed state as will be explained below. The forward end of handle 3 has a beveled head 15. Bore 7 is swaged down to reduce the diameter D within head 15.

A second section 27 is formed from cylindrical wall 19 which defines an inner bore 21. Wall 19 has an outside diameter slightly less than diameter of bore 7 in handle 3 so that section 17 can fit within bore 7. Section 17 is formed from any appropriate composite material such as nylon, polycarbonate or kevlar. Forward end of section 17 has a bevelled head 23. Bore 21 is swaged down to reduce the diameter D2 at a point corresponding internally to bevel head 23.

The aft section has an external collars 24 and 25. The outside diameter of collar 25 is essentially the same as diameter D in the forward end of bore 7 of handle section 3.

An end section 27 is formed from cylindrical wall 29 which defines bore 31. Forward end of bore 31 has internal threads 33 to engage the threaded portion 35 of end plug 37. The aft end of section 27 has an external collar 32 and 33 formed thereon. Collar 33 has essentially the same outside diameter as the diameter D2 of the swaged end of bore 21 of middle section 17.

An elongated iron rod 39 with an outside diameter slightly less than diameter of bore 31, is inserted into bore 31. Rod 39 has a circular end piece 41 integrally formed from iron. The diameter of end piece 41 is greater than the diameter of bore 31 so that the body of rod 39 fits within bore 31 while end piece 41 of abuts collar 33.

In use, the arrangement of the elements are as indicated in FIGS. 2 and 3. Second section 17 fits within bore 7 of handle piece 3. End section 27 fits within bore 21 of second section 17. When collapsed the end piece 41 of the iron rod 39 abuts the magnet 14 in end cap 11. This magnetic attraction releasably holds the baton in a collapsed state. A sharp swing of the handle in arc causes the metal rod to exert force so that the inner telescoping sections thrust outward under centrifugal force. Collar 33 on end piece 27 engages the swaged section at diameter D2 of internal bore 21 of the second section thereby releasably locking it in place. Correspondingly, collar section 25 of second section 17 engages the diameter D1 at the swaged end of internal bore 7 of handle 3 also locking it in place. This arrangement is best illustrated in FIG. 3.

To retract the various elements of the baton, the user strikes the metallic end piece 37 against the floor or wall driving the collar sections 33 and 25 away from the swaged diameters D2 and D1 respectively thus allowing the telescoping sections to collapse within each other. Magnet 14 engages, section 41 of iron rod 39 as previously described.

It will be obvious to those skilled in the art that various changes or modification can be made in the expandable baton of the present invention without departing from the scope of the appended claims. Therefore, the preceding description and accompanying drawings are intended to be illustrative only and should not be construed in a limiting sense.

What is claimed:

1. A telescoping baton for use in self-defense or training, comprising:

a cylindrical handle section having an axial bore formed therein, said handle section formed of a composite material;

a cylindrical second section disposed within said axial bore and said handle section, and being capable of being extended out of said handle section or retracted into said handle section, said second section having an axial bore formed therein, said second section being formed of said composite material;

an end section disposed within said second section and being capable of being extended out of said second section, and retracted into said second section, said end section being formed of said composite material;

said composite material is selected from a group containing nylon, polycarbonate, and kevlar:

a metal rod means disposed inside said end section to provide a weight and add rigidity to said end section, said metal rod means extending substantially the length of said end section, and having the composite material forming said end section provided surrounding said rod means;

said handle having an end cap, said end cap having a magnet mounted centrally therein to magnetically engage said rod means disposed in said end section to provide a magentic holding means for retaining said telescoping baton in its retracted position; and said end cap is removable to allow assembly of said sections.

2. The invention of claim 1 and including a metallic end piece threaded into the outer end of said rod means to enhance the weight of the telescoping baton at its extended-most end during usage.

* * * * *